US005636458A

United States Patent [19]

Drake

[11] Patent Number: 5,636,458

[45] Date of Patent: Jun. 10, 1997

[54] CURB SHOE FOR PLOW BLADE

[76] Inventor: Roy S. Drake, 1501 N. Minnesota Ave., Sioux Falls, S. Dak. 57101

[21] Appl. No.: 570,129

[22] Filed: Dec. 11, 1995

[51] Int. Cl.[6] ..... E01H 5/04

[52] U.S. Cl. ..... 37/270; 37/266

[58] Field of Search ..... 37/231, 233, 266, 37/268, 270, 271, 272, 274, 275, 276, 279, 903, 906, 924

[56] References Cited

U.S. PATENT DOCUMENTS

| | | | |
|---|---|---|---|
| 2,772,490 | 12/1956 | Hnastchenko | 37/271 X |
| 2,983,058 | 5/1961 | Hertz | 37/270 X |
| 3,432,948 | 3/1969 | Myers | 37/270 |
| 4,073,076 | 2/1978 | Fortune | 37/266 |
| 4,346,528 | 8/1982 | Shwayder | 37/270 |
| 5,477,600 | 12/1995 | Houle et al. | 37/266 X |

*Primary Examiner*—Terry Lee Melius
*Assistant Examiner*—Robert Pezzuto

[57] ABSTRACT

A new curb shoe for a plow blade for extending the wear time of plow blades. The inventive device includes a curb shoe mountable to a plow blade. A shaft guard attached to a mounting mountable to a plow blade. The shaft guard is welded to the mounting and includes fastener holes in the mounting allowing a fastener locking end to pass through the mounting and the plow blade with a fastener head to index in a fastener hole groove. The fastener locking end is locked in position, binding the mounting to the plow blade.

10 Claims, 4 Drawing Sheets

CURB SHOE FOR PLOW BLADE

BACKGROUND OF THE INVENTION

1. Field of the Invention

The present invention relates to guards for plow blades and more particularly pertains to a new curb shoe for plow blade for extending the wear time of plow blades.

2. Description of the Prior Art

The use of guards for plow blades is known in the prior art. More specifically, guards for plow blades heretofore devised and utilized are known to consist basically of familiar, expected and obvious structural configurations, notwithstanding the myriad of designs encompassed by the crowded prior art which have been developed for the fulfillment of countless objectives and requirements.

Known prior art guards for plow blades include U.S. Pat. No. 4,899,472; U.S. Pat. No. 4,833,801; U.S. Pat. No. 4,069,604; U.S. Pat. No. 4,290,214; U.S. Pat. No. 4,347,677; U.S. Pat. No. 4,346,528 and U.S. Pat. No. 4,450,635.

While these devices fulfill their respective, particular objectives and requirements, the aforementioned patents do not disclose a new curb shoe for plow blade for extending the wear of a plow blade including a shaft guard means attached to a mounting means mountable to a plow blade, the shaft guard means welded to the mounting member, fastener holes in the mounting means allowing fastener means locking end to pass through the mounting means and the plow blade with the fastener means head indexing in the fastener hole groove, and fastener means locking end locked in position binding the mounting means to the plow blade.

In these respects, the curb shoe for plow blade according to the present invention substantially departs from the conventional concepts and designs of the prior art, and in so doing provides an apparatus primarily developed for the purpose of guards to extend the wear time of plow blades.

SUMMARY OF THE INVENTION

In view of the foregoing disadvantages inherent in the known types of storage devices now present in the prior art, the present invention provides a new curb shoe for plow blade construction wherein the same can be utilized for guards to extend the wear time of plow blades. As such, the general purpose of the present invention, which will be described subsequently in greater detail, is to provide a new curb shoe for plow blade apparatus and method which has many of the advantages of the guards for plow blades mentioned heretofore and many novel features that result in a new curb shoe for plow blade which is not anticipated, rendered obvious, suggested, or even implied by any of the prior art storage devices, either alone or in any combination thereof.

To attain this, the present invention generally comprises a shaft guard means attached to a mounting means mountable to a plow blade. The shaft guard means is welded to the mounting member. The fastener holes in the mounting means allowing fastener means locking end to pass through the mounting means and the plow blade with the fastener means head indexing in the fastener hole groove. The fastener means locking end is locked in position binding the mounting means to the plow blade.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new curb shoe for plow blade apparatus and method which has many of the advantages of the guards for plow blades mentioned heretofore and many novel features that result in a new curb shoe for plow blade which is not anticipated, rendered obvious, suggested, or even implied by any of the prior art storage devices, either alone or in any combination thereof.

It is another object of the present invention to provide a new curb shoe for plow blade which may be easily and efficiently manufactured and marketed.

It is a further object of the present invention to provide a new curb shoe for plow blade which is of a durable and reliable construction.

An even further object of the present invention is to provide a new curb shoe for plow blade which is susceptible of a low cost of manufacture with regard to both materials and labor, and which accordingly is then susceptible of low prices of sale to the consuming public, thereby making such curb shoe for plow blade economically available to the buying public.

Still yet another object of the present invention is to provide a new curb shoe for plow blade which provides in the apparatuses and methods of the prior art some of the advantages thereof, while simultaneously overcoming some of the disadvantages normally associated therewith.

Still another object of the present invention is to provide a new curb shoe for plow blade for guards to extend the wear time of plow blades.

It is an additional object of the present invention is to provide a new curb shoe for plow blade that protect street curbing and reduce the damage done by plows being run against the curbing.

An even additional objective of the present invention is to provide a new curb shoe for plow blade that is safer to operate.

It is another objective of the present invention is to provide a new curb shoe for plow blade is environmental friendly by requiring less materials through longer wear and by reducing the damage down while plowing.

Yet another object of the present invention is to provide a new curb shoe for plow blade which includes a shaft guard means attached to a mounting means mountable to a plow blade, the shaft guard means welded to the mounting member, fastener holes in the mounting means allowing fastener means locking end to pass through the mounting means and the plow blade with the fastener means head indexing in the fastener hole groove, and fastener means locking end locked in position binding the mounting means to the plow blade..

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
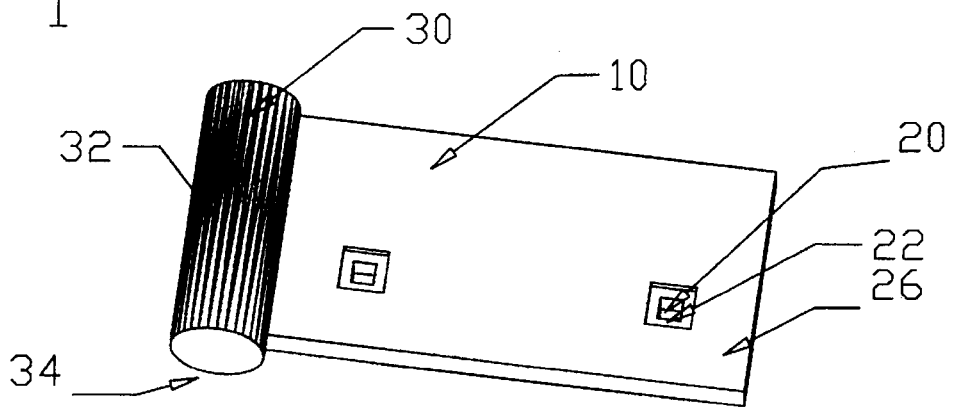
FIG. 1 is an isometric illustration of a new curb shoe for plow blade according to the present invention.

With reference now to the drawings, and in particular to FIGS. 1–7 thereof, a new curb shoe for plow blade embodying the principles and concepts of the present invention and generally designated by the reference numeral 10 will be described.

More specifically, it will be noted that the curb shoe for plow blade 10 comprises a shaft guard means 30 secured to a mounting means 20 mounted on a plow blade 52 attached to a plow 50.

Figure 2:
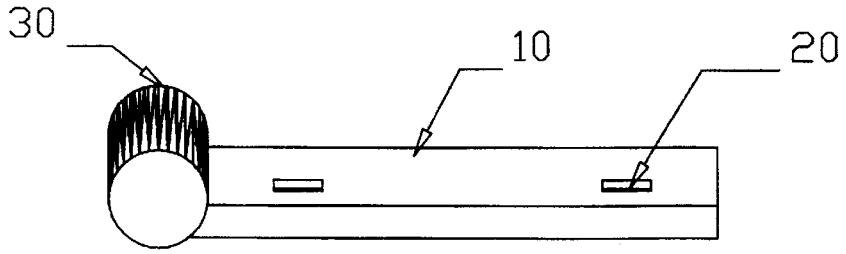
FIG. 2 is a side elevation view thereof.
Figure 3:
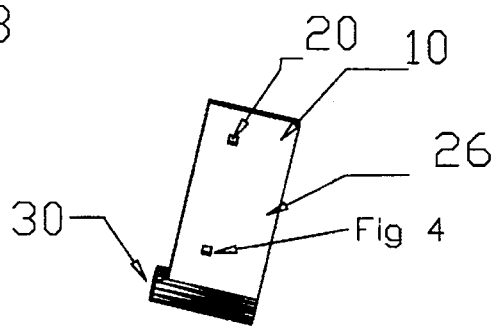
FIG. 3 is a rear elevation view of the invention

As best illustrated in FIGS. 1 through 3, it can be shown that the mounting means 20 according to the present invention 10 preferably comprises a plate member 20 with multiple fastener holes 22 positioned to match the fastener hole in plow blades. The shaft guard means 30 is welded to the mounting means 20. The shaft guard means 30 has a shank member 32 and a surface contact member 34. The surface contact member 34 is positioned one half inch below the lower edge of the mounting means 20. The preferred shape of shank member 32 is cylindrical. The shank member 32 is made of a dense material. The mode for making the shank member 32 is from rolled steel.

Figure 4:
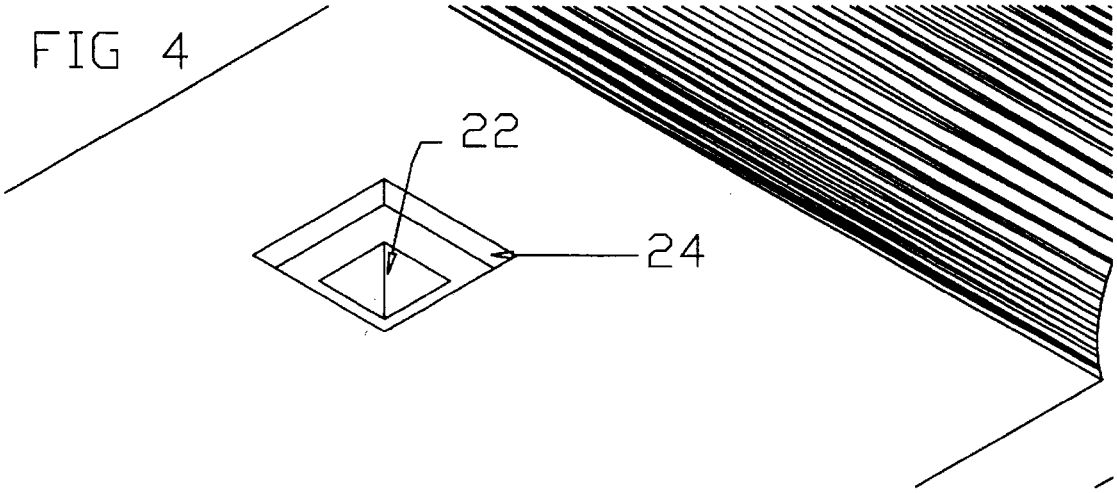
FIG. 4 is an isolated view of the fastener hole as shown in FIG. 1.
Figure 7:
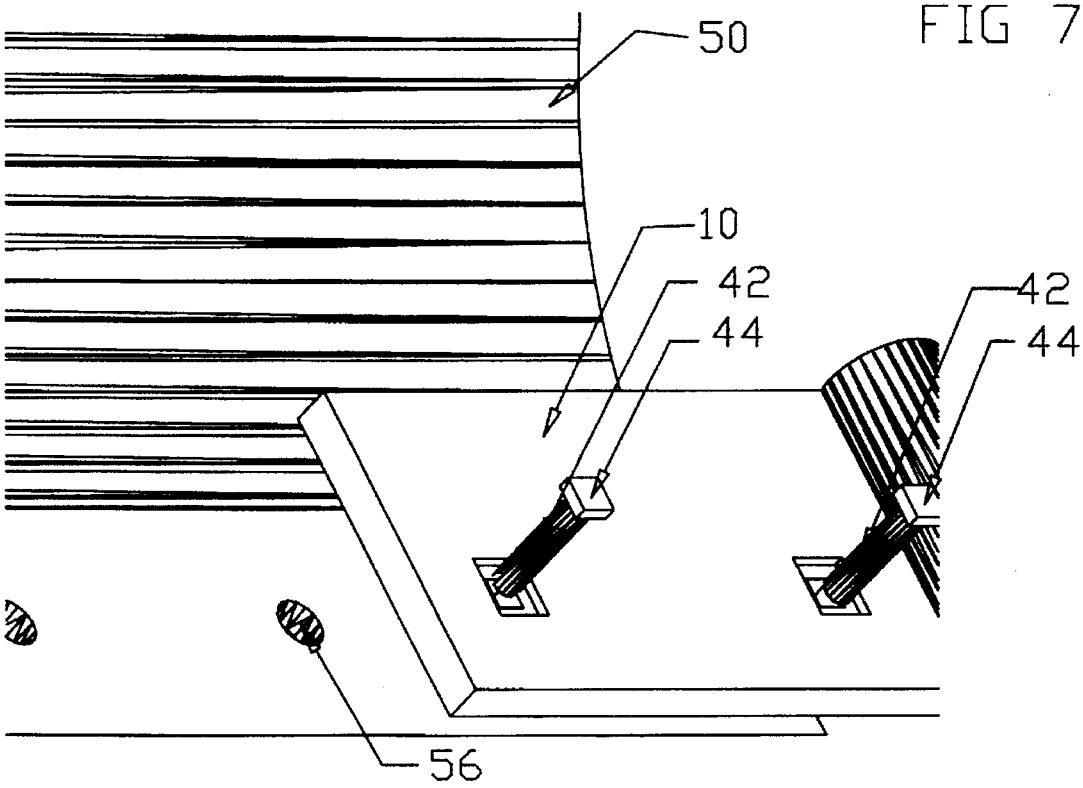
FIG. 7 is an exploded isometric illustration of the invention as isolated and mounted in FIG. 6.
Figure 8:
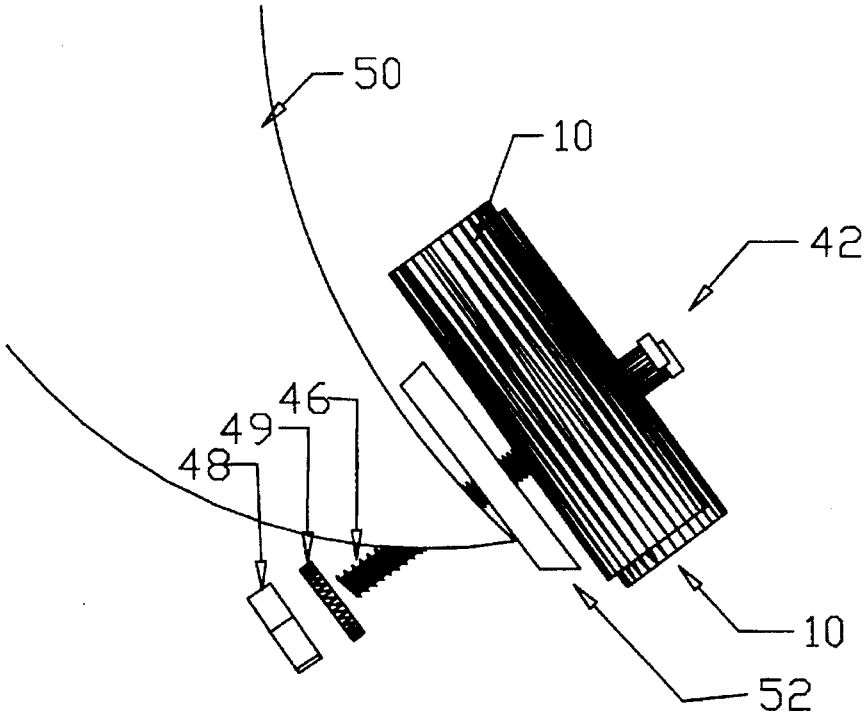
FIG. 8 is an exploded isometric illustration of the invention as isolated and mounted in FIG. 6.

As best illustrated in FIGS. 4 and 7, it can be shown that the fastener hole 22 has a fastener hole groove 24. The fastener hole 22 receives a fastener means 40. The fastener means 40 has a fastener means shaft 42 which terminates at one end in a fastener means head 44. The fastener means head 44 indexes into the fastener hole groove 24. The end opposite of the fastener means head 44 of the fastener means shaft 42 terminates is a fastener means locking end 46. The fastener means locking end 46 receives a locking means 48.

Figure 5:
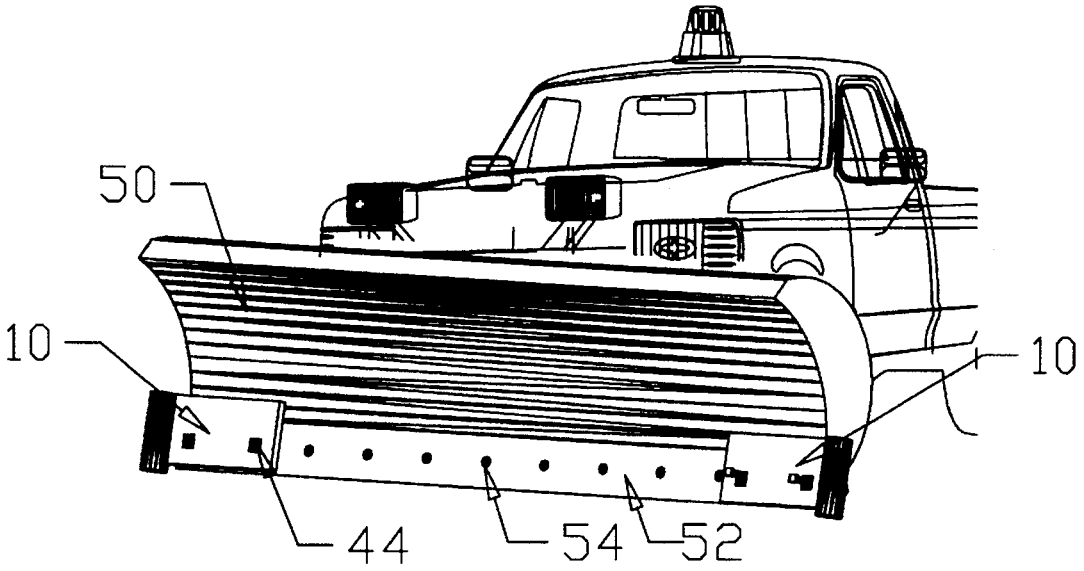
FIG. 5 is a front perspective view of the invention mounted on a snow plow blade.
Figure 6:
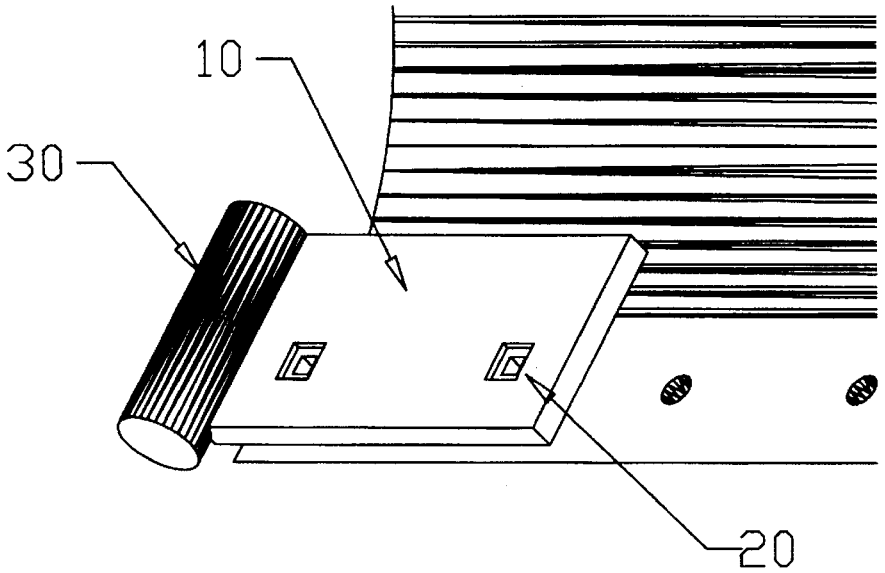
FIG. 6 is an isolated view of the invention mounted on a snow plow blade as shown in FIG. 5.

As best illustrated in FIGS. 5, 6 and 7, it can be shown that the curb shoe mounts directly to a plow 50. This illustration shows the curb shoe mounted to a snow plow. The plow 50 mounted on the bottom edge a plow blade 52. The curb shoe 10 is mounted to the plow blade 52 and the plow 50. The fastener holes 22 in mounting means 20 are positioned to correspond to the plow blade attaching holes 56 and the corresponding plow attaching holes 54. The fastener means 40 passes through the fastener hole 22, the plow blade attaching hole 54 and finally the plow attaching hole 54. When fully inserted the fastener means head 44 of the fastener means shaft 42 indexes into the fastener hole groove 24. The fully inserted and indexed fastener means 40 is secured in the inserted position by the locking means 48 being received and locked to fastener means locking end 46 not labeled.

With further reference to FIGS. 5–7 and 8, it can be shown that the fastener means locking end 46 is threaded to receive locking means 48 which is a threaded nut. A washer 49 is placed over the fastener means locking end 46 not labeled before the locking means 50 is tightened.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A curb shoe for a plow blade, comprising:

a stationary shaft guard means; and a mounting means for mounting the stationary shaft guard means to the plow blade;

wherein the stationary shaft guard means comprises a substantially cylindrical shank member and the mounting means comprises a plate member fixedly attached to the outer circumference of the cylindrical shank member so as to prevent rotation of the shank member relative to the plate member.

2. The curb shoe of claim 1, wherein the plow blade includes a bottom edge, and the substantially cylindrical shank member extends below the bottom edge of the plow blade.

3. The curb shoe of claim 1, wherein the shank member and plate member are attached by welding.

4. The curb shoe of claim 1, wherein the shank member is made of a dense material for enhancing the wearability of the shank member.

5. The curb shoe of claim 4, wherein the dense material comprises rolled steel.

6. The curb shoe of claim 1, wherein the plate member includes a fastener hole which receives a fastener means to bind the plate member to the plow blade.

7. The curb shoe of claim 6, wherein the fastener hole is grooved to receive a head of the fastener means therein.

8. A curb shoe for a plow blade, comprising:

a shaft guard means comprising a substantially cylindrical, stationary shank member made from rolled steel and having a surface contact end;

a mounting means comprising a flat plate member welded to the outer circumference of the stationary shank member so as to prevent rotation of the shank member relative to the plate member, said plate member including at least one fastener hole therein; and a fastener means comprising a fastener shafts, a fastener head attached to one end of the fastener shaft, and a threaded locking end at an opposite end of the fastener shaft.

9. The curb shoe of claim 8, wherein the fastener hole is grooved to receive the fastener head therein.

10. The curb shoe of claim 9, wherein the plow blade includes a bottom edge, and the substantially cylindrical shank member extends below the bottom edge of the plow blade about one half inch.

* * * * *